US009121284B2

(12) United States Patent
Pope

(10) Patent No.: US 9,121,284 B2
(45) Date of Patent: Sep. 1, 2015

(54) MODAL TUNING FOR VANES

(75) Inventor: Andrew Pope, Glendale, NY (US)

(73) Assignee: United Technologies Corporation, Hartford, CT (US)

( * ) Notice: Subject to any disclaimer, the term of this patent is extended or adjusted under 35 U.S.C. 154(b) by 779 days.

(21) Appl. No.: 13/360,007

(22) Filed: Jan. 27, 2012

(65) Prior Publication Data

US 2013/0195652 A1 Aug. 1, 2013

(51) Int. Cl.

| | |
|---|---|
| ***F01D 5/16*** | (2006.01) |
| ***F01D 5/14*** | (2006.01) |
| ***F01D 25/16*** | (2006.01) |
| ***F04D 29/54*** | (2006.01) |
| ***F04D 29/66*** | (2006.01) |

(52) U.S. Cl.

CPC ..... *F01D 5/141* (2013.01); *F01D 5/147* (2013.01); *F01D 5/16* (2013.01); *F01D 25/162* (2013.01); *F04D 29/542* (2013.01); *F04D 29/544* (2013.01); *F04D 29/663* (2013.01); *F05D 2260/961* (2013.01)

(58) Field of Classification Search

CPC ..... F01D 5/141; F01D 5/147; F01D 5/16; F01D 25/162; F04D 29/542; F04D 29/544; F04D 29/663; F05D 2260/961

USPC ..... 416/203, 229 R, 229 A, 235, 236 R, 232, 416/233, 500

See application file for complete search history.

(56) References Cited

U.S. PATENT DOCUMENTS

| | | | | | |
|---|---|---|---|---|---|
| 2,916,258 | A | * | 12/1959 | Klint | 416/203 |
| 5,577,884 | A | | 11/1996 | Mari | |
| 5,634,771 | A | | 6/1997 | Howard et al. | |
| 5,839,882 | A | * | 11/1998 | Finn et al. | 416/229 A |
| 5,947,688 | A | | 9/1999 | Schilling et al. | |
| 6,033,186 | A | | 3/2000 | Schilling et al. | |
| 6,039,542 | A | * | 3/2000 | Schilling et al. | 416/233 |
| 6,287,080 | B1 | | 9/2001 | Evans et al. | |
| 6,364,616 | B1 | | 4/2002 | Stevenson et al. | |
| 6,884,507 | B2 | | 4/2005 | Lin et al. | |
| 7,429,165 | B2 | * | 9/2008 | Burdgick et al. | 416/229 A |
| 7,458,780 | B2 | | 12/2008 | Weisse et al. | |
| 8,083,489 | B2 | * | 12/2011 | Viens et al. | 416/229 R |
| 8,834,098 | B2 | * | 9/2014 | Glaspey | 415/119 |
| 2004/0198852 | A1 | | 10/2004 | Lin et al. | |
| 2006/0272884 | A1 | * | 12/2006 | Vilcek et al. | 181/198 |
| 2008/0253887 | A1 | * | 10/2008 | Cairo et al. | 415/221 |

* cited by examiner

*Primary Examiner* — Nathaniel Wiehe
*Assistant Examiner* — Brian O Peters
(74) *Attorney, Agent, or Firm* — Miller, Mathias & Hull LLP

(57) ABSTRACT

A vane having a cambered airfoil body is frequency-tuned via a number of cavities formed in a surface of the vane. At least some of the cavities are filled with a nonmetallic filler material, and the remainder of the cavities are left unfilled. A cover is affixed to the vane so as to cover at least the unfilled cavities. In an embodiment, the filling and covering of cavities is performed in a manner that excludes the frequency modes of the guide vane from a precluded band, e.g., an engine excitation band.

22 Claims, 10 Drawing Sheets

MODAL TUNING FOR VANES

TECHNICAL FIELD

This patent disclosure relates generally to vanes in gas turbine engines and, more particularly to tuning a modal response of classes of airfoil-shaped vanes for gas turbine engines.

BACKGROUND

A gas turbine operates by compressing air, combining the compressed air with fuel, igniting the mixture, and harnessing the expansion of the burning fuel to produce work. The exhaust stream in turn is utilized in part to assist the engine in perpetuating the cycle of compression, burning, and expansion. In a typical gas turbine engine, the compressor includes a set of spinning blade discs, sometimes referred to as compressor discs. Similarly, the portions of the engine after the combustion chamber, including the final stage, are comprised of one or more blade discs, sometimes referred to as turbine discs.

In order to maintain the various spinning blade discs of the gas turbine in a designed location within the engine housing, and in particular with respect to a close-fitting cylindrical air guide, structural supports are employed. These structural supports essentially bridge the engine housing to a central bearing for supporting the primary engine shaft. Because of the large volume of air and gases moving within the housing, and the high speeds at which such movement occurs, it is beneficial for the structural supports which extend into such airflow to be airfoil-shaped.

Such structural supports are typically constructed so as to withstand the relatively static stress imposed on them, e.g., compressive stress, torsional stress, buckling stress, etc. However, even when the structure exhibits adequate static strength in these areas, there are many vibrational excitations within a gas turbine engine, and these excitations can be transferred to the structural supports to induce additional stress. Moreover, if a modal response or resonance of a structural support is close in frequency to a substantial vibrational excitation of the engine, cumulative energy absorption occurs in the structural support resulting in sympathetic and potentially violent oscillations, leading to potential failure of the structural support.

However, due to impediments in the airflow within the engine, the vanes include several different airfoil shapes. The airfoil of a particular guide vane will depend upon where in the engine it is located relative to an impediment such as an engine mounting strut. For example, guide vanes directly upstream of the impediment may be shaped to modify and redirect the airflow more significantly than guide vanes that are not directly upstream of the impediment.

As noted above, the modal response of engine blades and vanes may be tuned to avoid certain high-energy frequency bands. However, unlike compressor and turbine blades which are largely identical, the wide variety of shapes for vanes increases the complexity of trying to tune each such element. Thus, the inventors have observed that a more efficient system is needed for allowing the frequency modes of vanes to be properly tuned.

It will be appreciated that this background description has been created by the inventors to aid the reader, and is not to be taken as a reference to prior art, nor as an indication that any of the indicated problems were themselves appreciated in the art. While the principles described hereinafter may in some embodiments alleviate problems inherent in other systems, the scope of the protected innovation is defined by the attached claims, and not otherwise by the ability to solve any specific problem.

SUMMARY

In an embodiment, a set of vanes is provided for use in a gas turbine. The set of vanes includes at least a first vane having a first camber, the first vane having an airfoil-shaped body portion having a plurality of cavities on at least one surface thereof, the first vane having a first degree of coverage by a first cover portion, wherein a degree of coverage represents an extent to which cavities of a surface are covered, the first vane having a first frequency response with at least a first mode. The set of vanes further includes at least a second vane having a second camber different from the first camber, the second vane having an airfoil-shaped body portion having a plurality of cavities on at least one surface thereof, the second vane having a second degree of coverage by a second cover portion, the second vane having a second frequency response with at least a second mode. The first camber differs from the second camber and the second degree of coverage differs from the first degree of coverage.

In an additional or alternative embodiment of any of the foregoing embodiments, neither of the first and second modes falls within a predetermined frequency band. In a further additional or alternative embodiment of any of the foregoing embodiments, the plurality of cavities are located at least on respective suction surfaces of the first and second vanes. In a further additional or alternative embodiment of any of the foregoing embodiments, the plurality of cavities are located at least on respective pressure surfaces of the first and second vanes. In an additional or alternative embodiment of any of the foregoing embodiments, each of the first and second degrees of coverage fall within a range from zero coverage to full coverage, and in a further additional or alternative embodiment of any of the foregoing embodiments, at least one of the first and second cover portions comprises a plurality of covering members.

In an additional or alternative embodiment of any of the foregoing embodiments, a subset of the cavities of at least one of the first vane and the second vane is filled with a nonmetallic filler material, and in yet a further additional or alternative embodiment of any of the foregoing embodiments, the nonmetallic filler material is a structural foam material. In a further additional or alternative embodiment of any of the foregoing embodiments, the nonmetallic filler material comprises an added constituent including at least one of a fiber material and a microsphere material. At least one of the subset of the cavities is both filled and covered in an additional or alternative embodiment of any of the foregoing embodiments.

In another embodiment, a method is provided for tuning modes of a set of differently cambered vanes for use in a gas turbine, by providing a first plurality of vanes having a first camber and having a plurality of cavities on at least one surface thereof, and providing a second plurality of vanes having a second camber and having a plurality of cavities on at least one surface thereof, wherein the second camber differs from the first camber, tuning a frequency response of the first plurality of vanes by at least one of covering and filling of each cavity in each vane of the first plurality of vanes with a filler material such that the first plurality of vanes have a first set of frequency modes, and none of the first set of frequency modes falls within a predetermined band, and tuning a frequency response of the second plurality of vanes by identifying a front portion of the second airfoil that is substantially the same as a front portion of the first airfoil, covering or filling each cavity in the front portion of each vane of the second plurality of vanes in the same manner as each cavity in the front portion of each vane of the first plurality of vanes, and independently tuning a remaining portion of each vane of the second plurality of vanes by at least one of covering and filling of each cavity in the remaining portion.

In an additional or alternative embodiment of any of the foregoing embodiments, the plurality of cavities are located on at least respective suction surfaces of the first and second pluralities of vanes. In a further additional or alternative embodiment of any of the foregoing embodiments, the plurality of cavities are located on at least respective pressure surfaces of the first and second pluralities of vanes.

In an additional or alternative embodiment of any of the foregoing embodiments, the method further includes tuning the frequency response of at least one of the first and second plurality of vanes by adjusting one or more of a depth of the cavities, a ratio of cavitated surface area to non-cavitated surface area, addition of ribs, removal of ribs, and a change in a density, strength, or resilience of the filler material. The filler material may but need not comprise a nonmetallic filler material. In a further additional or alternative embodiment of any of the foregoing embodiments, the nonmetallic filler material is a structural foam material. In yet a further additional or alternative embodiment of any of the foregoing embodiments, the nonmetallic filler material comprises an added constituent including at least one of a fiber material and a microsphere material. In a further additional or alternative embodiment of any of the foregoing embodiments, a cavity of at least one of the first plurality of vanes and the second plurality of vanes is both filled and covered.

In another embodiment, a gas turbine engine includes an annular passage configured to direct a flow of gaseous material, and a vane disposed at least partially within the annular passage. The vane includes a cambered airfoil body having a leading edge, trailing edge, pressure surface, and suction surface, a plurality of cavities formed in at least one of the pressure surface and the suction surface, with at least a subset of the plurality of cavities being filled with a nonmetallic filler material and a remainder of the plurality of cavities being unfilled with the nonmetallic filler material. A cover is affixed to the cambered airfoil body so as to cover the remainder of the plurality of cavities.

In an additional or alternative embodiment of any of the foregoing embodiments, the nonmetallic filler material is a structural foam material. In a further additional or alternative embodiment of any of the foregoing embodiments, the cover comprises a plurality of separate covering parts. The cover also covers a portion of the subset of the plurality of cavities filled with the nonmetallic filler material in an additional or alternative embodiment of any of the foregoing embodiments. In a further additional or alternative embodiment of any of the foregoing embodiments, the plurality of cavities are formed in one but not the other of the pressure surface and the suction surface.

Further and alternative aspects and features of the disclosed principles will be appreciated from the following detailed description and the accompanying drawings, of which:

DETAILED DESCRIPTION

Embodiments of the invention relate to the construction and modal tuning of airfoil-shaped vanes, for use within gas turbine engines, e.g., as fan exit guide vanes. In overview, a selectively hollowed primary structure is filled and optionally partially covered in order to both provide an airfoil surface and to tune the frequency response of the completed structure. In this way, the vibrational response of the resultant support structures can be customized to fall in a frequency range above or below high-vibration bands produced by the gas turbine engine. It will be appreciated that the response modes of a support structure may be torsional, flexural, compressive, etc., and that different modes of different types and/or in different dimensions may exist simultaneously in a given support structure.

Figure 1:
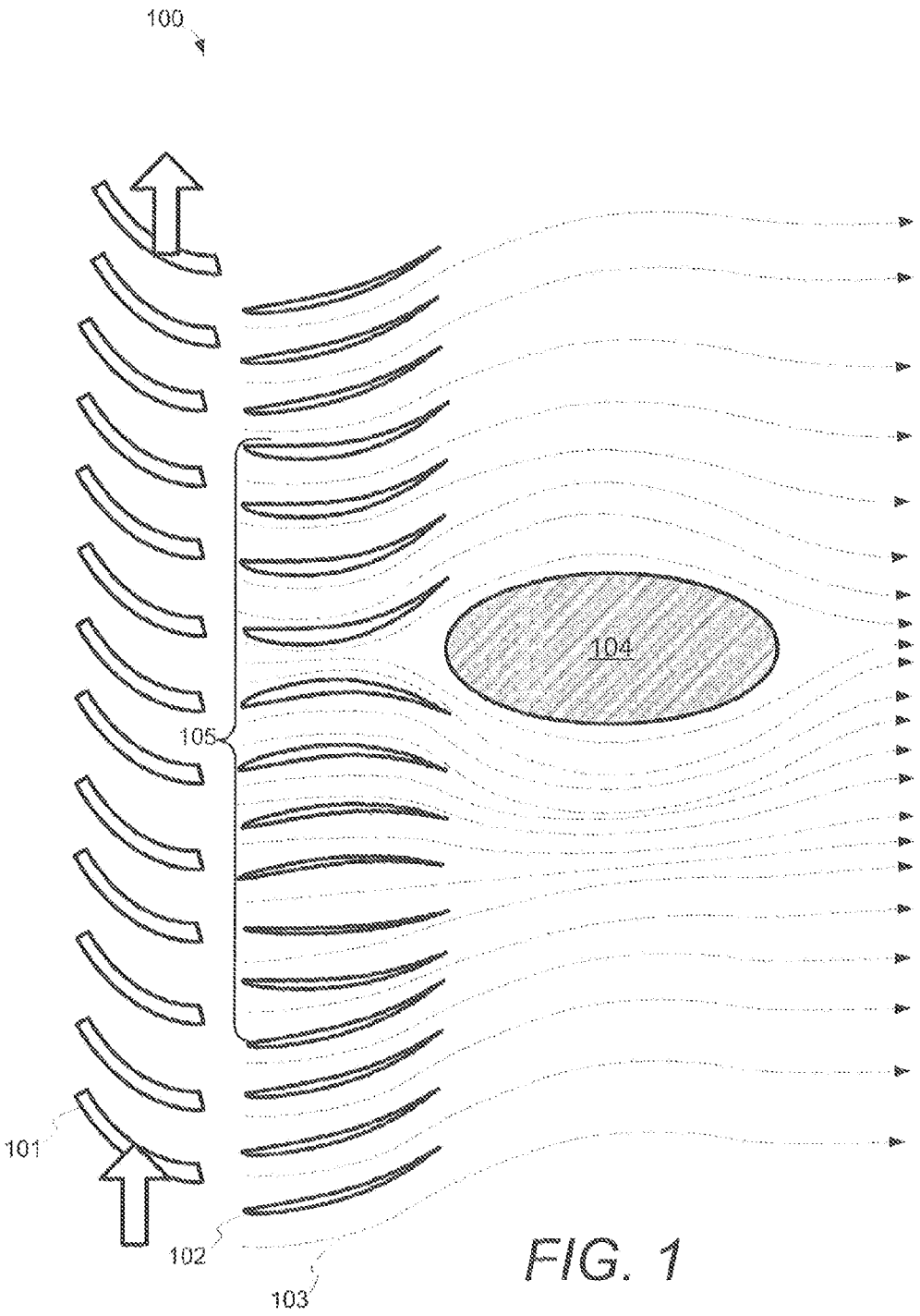
FIG. 1 is a schematic linearized end-view of a subset of blades and vanes within a gas turbine engine showing guide vanes of a plurality of classes (cambers)

Turning to the details of the preferred embodiments of the invention, FIG. 1 is a schematic linearized end-view of a subset of blades and vanes within a gas turbine engine. The schematic is idealized to show general features and is not intended to specifically represent any particular airfoils, angles of incidence, number of blades or vanes, etc.

The illustrated engine structure 100 includes a plurality of blades 101, e.g., compressor or turbine blades, as well as a plurality of vanes 102. It will be appreciated that the plurality of blades 101 are mounted to a rotatable disc or spindle in order to spin as a group, while the plurality of vanes 102 are static, and shape the airflow 103 produced as a result of the movement of the plurality of blades 101.

An impediment 104 is located in the airflow 103. The impediment may be an engine component, a mounting strut or bracket, etc., and it will be appreciated that it is typical to have at least one such impediment within a gas turbine engine as mounted. Because the impediment 104 may disrupt the airflow 103 and/or introduce turbulence into the airflow 103, it may lower the efficiency of the engine or reduce engine performance. As such, the guide vanes 102 may be modified to direct the airflow 103 in a more efficient manner around the impediment 104, avoiding the introduction of turbulence, air column oscillations and other detrimental phenomenon.

In the illustrated example, as can be seen, the guide vanes 102 in the region 105 of the impediment 104 have been modified from the airfoil and incidence of the other vanes so as to direct the airflow 103 smoothly past the impediment 104. While this technique is fairly effective in reducing turbulence and other undesirable airflow disruptions due to the impediment 104, it has the disruptive effect of introducing numerous variations into the guide vanes 102 which increase the difficulty in tuning the modal response of the structure as a whole. In other words, if a single guide vane shape were used, the combined structure would be more easily tuned by simply tuning an example of the singular design, and then producing each copy with the same characteristics.

When multiple guide vane airfoil cambers ("classes"), are employed, the tuning becomes more difficult in that each different class of vanes must be individually tuned. However, in an embodiment of the invention, the classes of guide vane airfoils are largely identical for a substantial portion of the chord, e.g., 75% of the chord, with the airfoil variation for each separate class of vane being introduced in the remaining portion of the airfoil, e.g., the remaining 25%. In a further embodiment of the invention, the modal response of the common portion is largely decoupled from the modal response of the class-specific portion, allowing for easier tuning of each vane class once the common portion is tuned.

Figure 2:
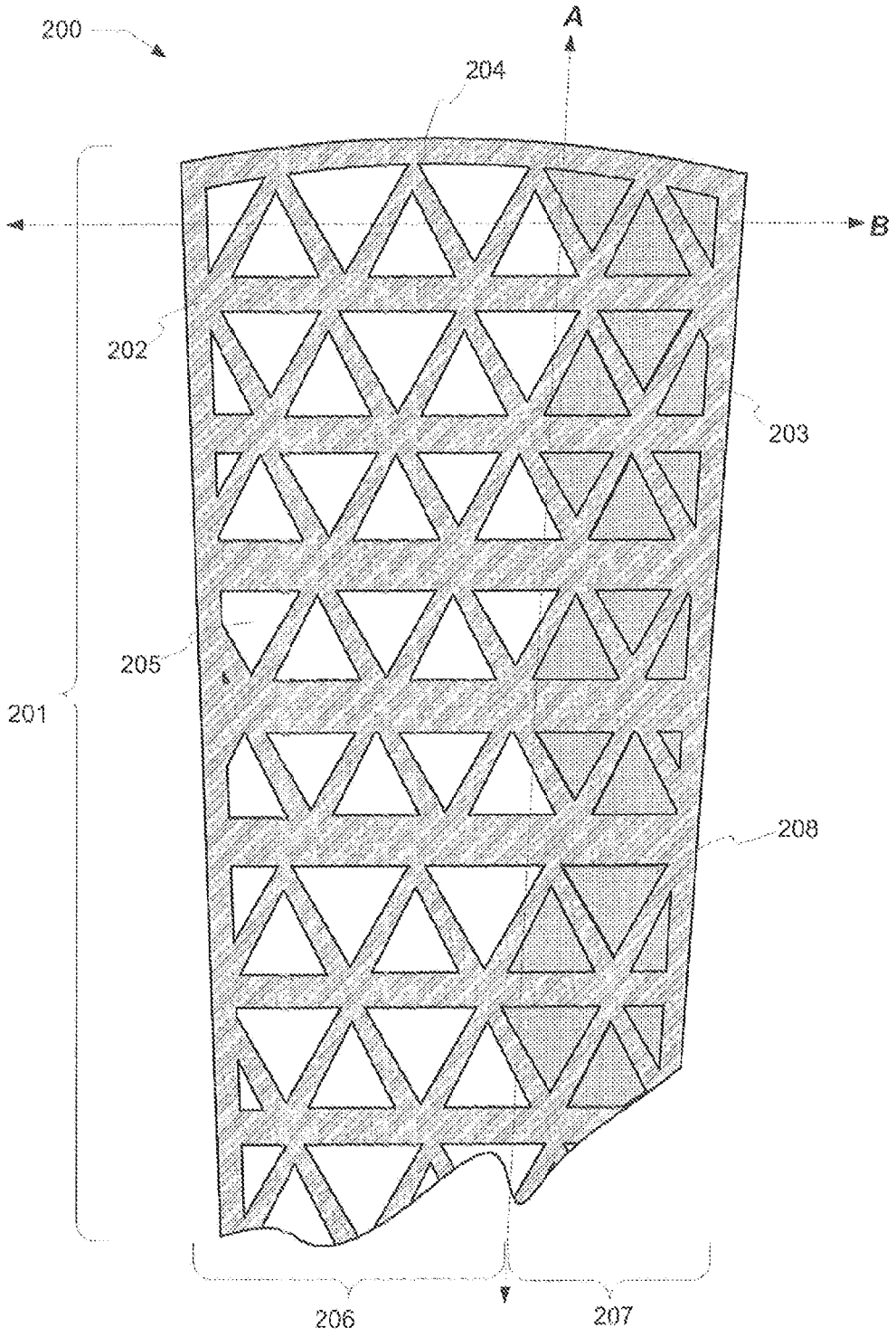
FIG. 2 is a sectional plan view of an example guide vane structure in keeping with an embodiment of the invention.

Although the precise shapes of the guide vanes and internal structures may be modified to suit each situation without departing from the scope of the described principles, FIG. 2 shows a sectional plan view of an example guide vane structure in keeping with an embodiment. The illustrated view is taken from the underside of the airfoil and omits any covers that may be used as discussed in greater detail further below. The illustrated guide vane 200 comprises a mounting portion, not shown, connected to an airfoil portion 201. The airfoil portion 201 has a leading edge portion 202 and a trailing edge portion 203. A tip portion 204 bridges the leading edge portion 202 and the trailing edge portion 203.

The guide vane 200 may be constructed of any suitable material such as various known metals, metal composites, metal alloys, and so on as will be appreciated by those of skill in the art. In addition, the airfoil portion 201 of the guide vane 200 is formed with, or machined to include, a number of cavities 205, e.g., in the underside (pressure side) 209 (FIG. 3) of the airfoil portion 201. It will be appreciated that the cavities 205 may additionally or alternatively be formed in the suction side 210 (FIG. 3) of the airfoil portion 201.

The airfoil portion 201 of the guide vane 200 can be considered to have a front portion 206 and a rear portion 207, with the front portion 206 of the guide vane 200 remaining substantially the same from one guide vane class to another, while the rear portion 207 of the guide vane 200 is altered for each guide vane class to increase or decrease the effective camber of the airfoil. This allows vanes of different classes to be used to provide varying degrees of airflow redirection dependent upon the intended placement location for the guide vane.

In the illustrated embodiment of the invention, certain of the cavities 205 in the airfoil portion 201 are filled with a substantially nonmetallic material 208. In an embodiment of the invention, the substantially nonmetallic material 208 is a structural foam material, which may be a closed or open cell material, and which may be filled with another material or substance to alter its density and/or structural properties. Again, it should be noted that although FIG. 3 illustrates the cavities 205 in the pressure side 209 of the airfoil portion 201, the cavities may instead be in the suction side 210, or in both sides as shown later herein.

In a preferred embodiment of the invention, the substantially nonmetallic material 207 is a structural foam material, optionally containing additional fibers, e.g., metal fibers or carbon fibers, microspheres such as hollow glass or hollow plastic microspheres, and/or other materials for altering the strength and/or density characteristics of the foam. The cavities to be filled may be filled by fitting premade units of cured filler material or, in a preferred embodiment, by injecting uncured filler into the formed cavities to allow the filler material to cure, form, and adhere in place. In an embodiment of the invention, an additional coating within the cavities is used prior to injecting the uncured foam to improve adhesion.

In the illustrated example, the cavities 205 in the rear portion 207 of the guide vane 200 are filled with the substantially nonmetallic material 208, while the cavities 205 of the front portion 206 of the guide vane 200 are left unfilled. In this scenario, a cover, not shown, may be used to create the pressure side airfoil surface of the guide vane 200 in the front portion 205. Similarly, a cover may be used over the filled cavities 205 of the rear portion 207 of the pressure side airfoil surface of the guide vane 200 depending on tuning needs, but is not necessary for maintaining an airfoil surface in this portion 207.

Figure 3:
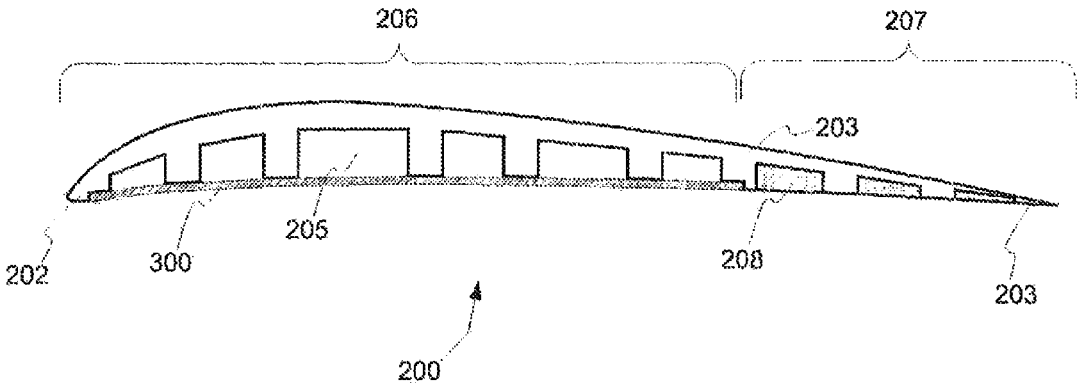
FIG. 3 is a cross-sectional end view of a guide vane such as is shown in FIG. 2, taken along axis A, through the guide vane at line B.

Turning to FIG. 3, this figure provides a cross-sectional end view of a guide vane such as that shown in FIG. 2, taken along axis A, through the guide vane at approximately level B. This figure shows a pattern of filling as in FIG. 2 and also includes a covering 300 not shown in the view of FIG. 2. In particular, as can be seen, the guide vane 200 includes several cavities 205 between the leading edge portion 202 and trailing edge portion 203 as discussed with reference to FIG. 2, with the cavities 205 in the rear portion 207 of the guide vane 200 being filled with a filler material 208, and the cavities 205 in the front portion 206 of the guide vane 200 being covered by the cover 300. The cover 300, which in an embodiment is constructed of a metal material, serves to provide a continuous airfoil surface over the unfilled cavities 205, but also provides additional rigidity to the guide vane 200, pushing its modal response higher than it would be if the unfilled cavities were instead filled and not covered.

The frequency mode effects of various permutations of filling and covering on the pressure side surface will be discussed in greater detail by reference to the examples provided in FIGS. 4A-C. Each of these figures shows a different combination of covering and filling of cavities in the pressure side of the airfoil. In conjunction with FIGS. 4A-C, FIGS. 5A-C show a set of respective idealized frequency mode plots for the configurations shown in FIGS. 4A-C, showing the nature of the expected frequency response of the particular guide vane structure in question.

Figure 4A:
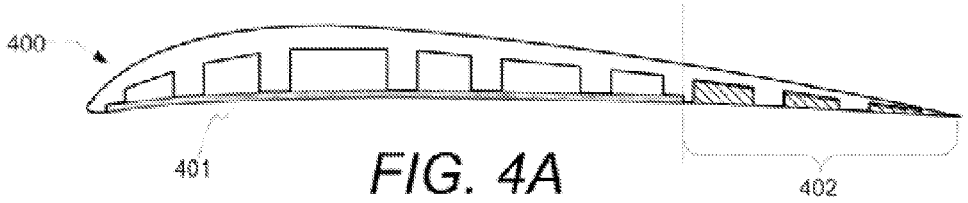
FIGS. 4A-C are cross-sectional end-views of guide vanes illustrating varying degrees of covering on the pressure surface of the airfoil according to embodiments of the invention.
Figure 4B:
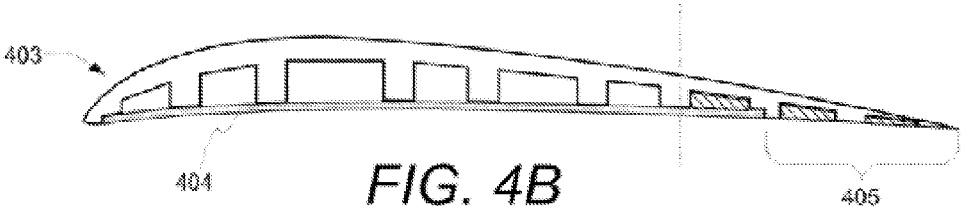
Figure 4C:
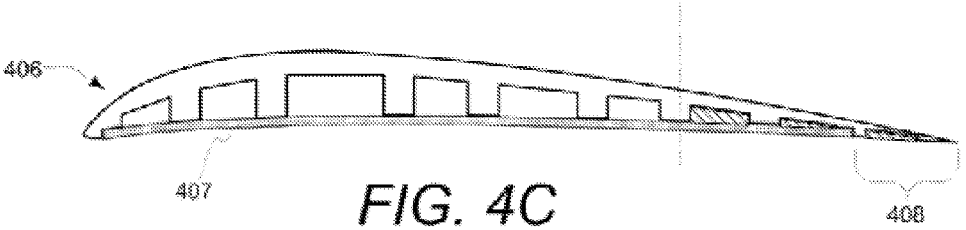

Turning specifically to FIG. 4A, this figure provides a cross-sectional end-view of a guide vane 400 as in FIG. 3, wherein a cover 401 is affixed substantially over the unfilled cavities of the vane 400 and not over the filled cavities. FIG. 4B shows a similar end view, but wherein the cover 404 extends over the unfilled cavities and also a portion of the filled cavities. Finally, FIG. 4C provides an end view of a similar vane structure 406, but wherein the cover 407 extends substantially over most of the filled cavities. In each case, the remaining portion of the structure that is uncovered 402, 405, 408 becomes sequentially smaller.

Figure 5A:
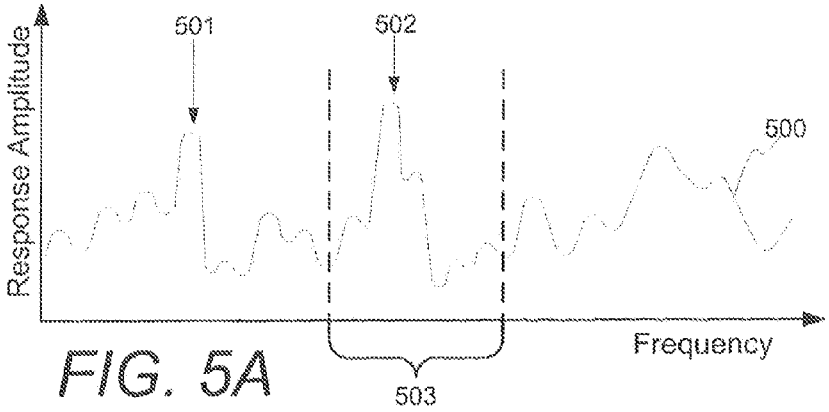
FIGS. 5A-C are example frequency response plots corresponding to the structures of FIGS. 4A-C.
Figure 5B:
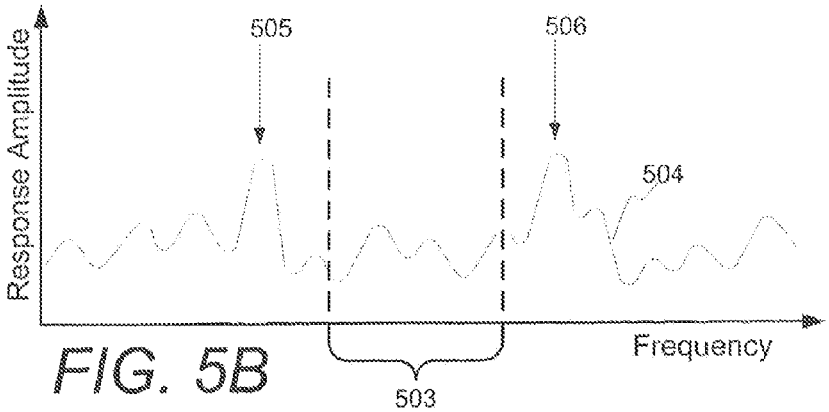
Figure 5C:
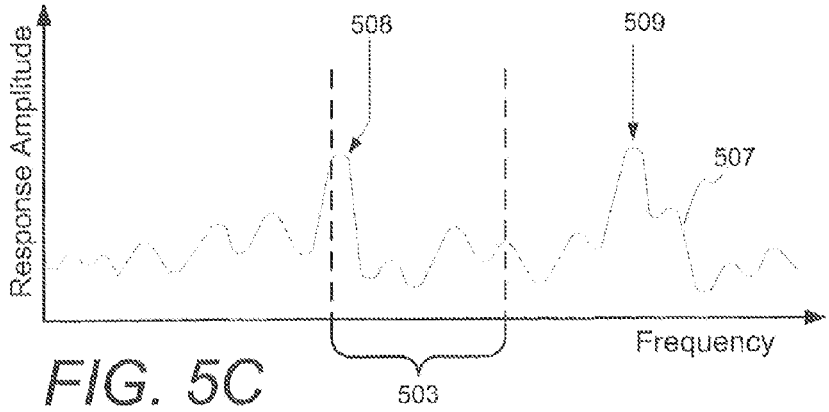

Turning to FIG. 5A, an example frequency response plot 500 of the structure shown in FIG. 4A is illustrated. In the illustrated example, the frequency response plot 500 contains two peaks, the first 501 of which falls below an engine excitation band 503 and the second 502 of which falls within the band 503. It will be appreciated that the illustrated plots of FIGS. 5A-C are simplified, and that an engine or other assembly having numerous rotating parts will often contain more than a single frequency band wherein excitation is high, and that a guide vane will typically include more than two modes of response.

While the frequency response 500 of the first vane structure 400 contained a response peak 502 within the excitation band 503 of the engine, extending the cover 404 as in structure 403 may serve to push the frequency response higher. Thus, for example, as seen in the frequency response plot 504 corresponding to structure 403, the frequency response contains two peaks 505, 506, but neither peak resides in the excitation band 503 of the engine. Thus, with this arrangement, energy from vibrations at frequencies within the excitation band 503 of the engine will not easily be transferred to the guide vane.

With multiple frequency response peaks, care is often needed during tuning to ensure that all response peaks remain outside the excitation band 503 of the engine. For example, as shown in FIG. 5C, the frequency response 507 of the vane structure 406 has increased all response peaks dues to increased rigidity of the entire structure, and as with the response 500 of structure 400, the response 507 of structure 406 includes a peak 508 within the excitation band 503 of the engine as well as a peak 509 outside the band 503.

Thus, of the three structures 400, 403, 406, only the middle structure 403 provides an acceptable frequency response under a criterion prohibiting response modes within the engine excitation band 503. Although the use of filler 208 within selected cavities 205 may also affect the frequency response of the resulting structure, the affect is not nearly as pronounced as the effect of shortening, extending, or eliminating the cover (or using multiple covers) since the cover not only exhibits a greater strength than the filler typically, but is also disposed at an external position. Because of this, in an embodiment of the invention, multiple distinct covers may be used in a given guide vane class to provide finer tuning to the extent needed.

Conversely, providing a cover over substantially the entirety of the pressure surface and attempting to tune the modal response of the vane via other variables will limit the tuning range due to the rigidity provided by the cover. Nonetheless, in conjunction with varying cover extent, other variables may be modified as well to provide finer degrees of tuning. Such other variables include, for example, the depth of the cavities 205, the ratio of cavitated surface area to non-cavitated surface area, the addition or removal of ribs, and the density, strength, and/or resilience of the filler material 208 (such as by varying composition, adding fibers, etc.).

Figure 6:
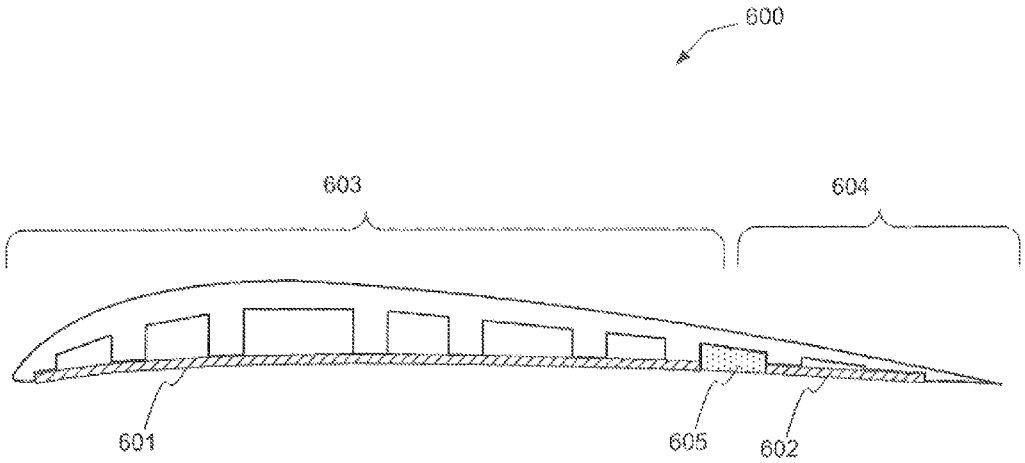
FIG. 6 is a cross-sectional end view of a guide vane having multiple distinct covers to tune the frequency response of the vane according to an embodiment of the invention.

Illustrating the use of multiple distinct covers to tune a guide vane, the guide vane structure 600 illustrated in FIG. 6 includes a first cover 601 on the pressure side of the structure in the forward portion 603, as well as a second cover 602 on the pressure side of the structure in the rear portion 604. In the illustrated example, an uncovered cavity between the first cover 601 and second cover 602 is filled with a filler material 605. In this structure, the frequency response of the front and rear portions of the guide vane 600 will be somewhat decoupled and thus somewhat independently tunable.

Figure 7A:
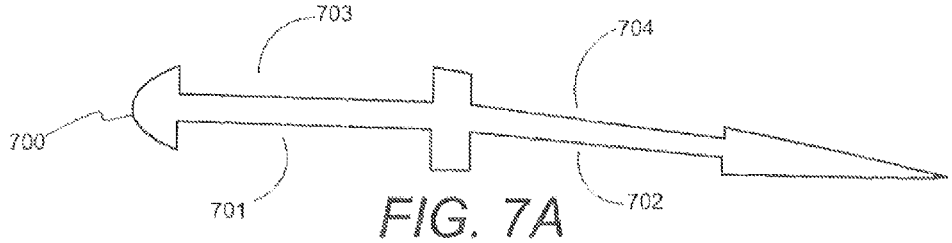
FIGS. 7A-7C show several different non-limiting variations for cavity placement within the airfoil portion of a vane.
Figure 7B:
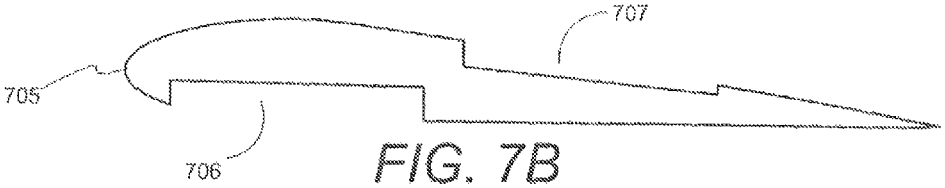
Figure 7C:
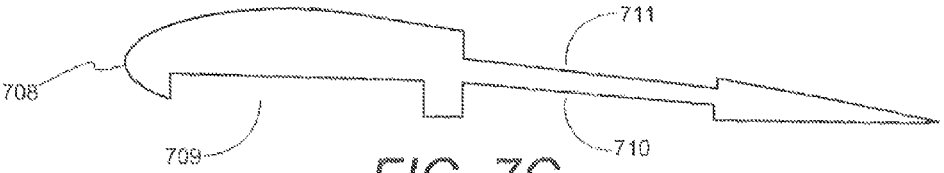

As noted above, the cavities in the airfoil body may be formed in one or both of the suction surface and the pressure surface. In this connection, FIGS. 7A-7C show several different non-limiting variations for cavity placement. FIG. 7A is a cross-sectional view of an airfoil portion of a vane 700 wherein cavities 701 and 702 are located on the pressure side of the airfoil while cavities 703 and 704 are located on the suction side of the airfoil. Similarly, FIG. 7B is a cross-sectional view of an airfoil portion of a vane 705 wherein cavity 706 is located on the pressure side of the airfoil while cavity 707 is located on the suction side of the airfoil. Finally, FIG. 7C is a cross-sectional view of an airfoil portion of a vane 708 wherein cavities 709 and 710 are located on the pressure side of the airfoil while cavity 711 is located on the suction side of the airfoil.

Figure 8:
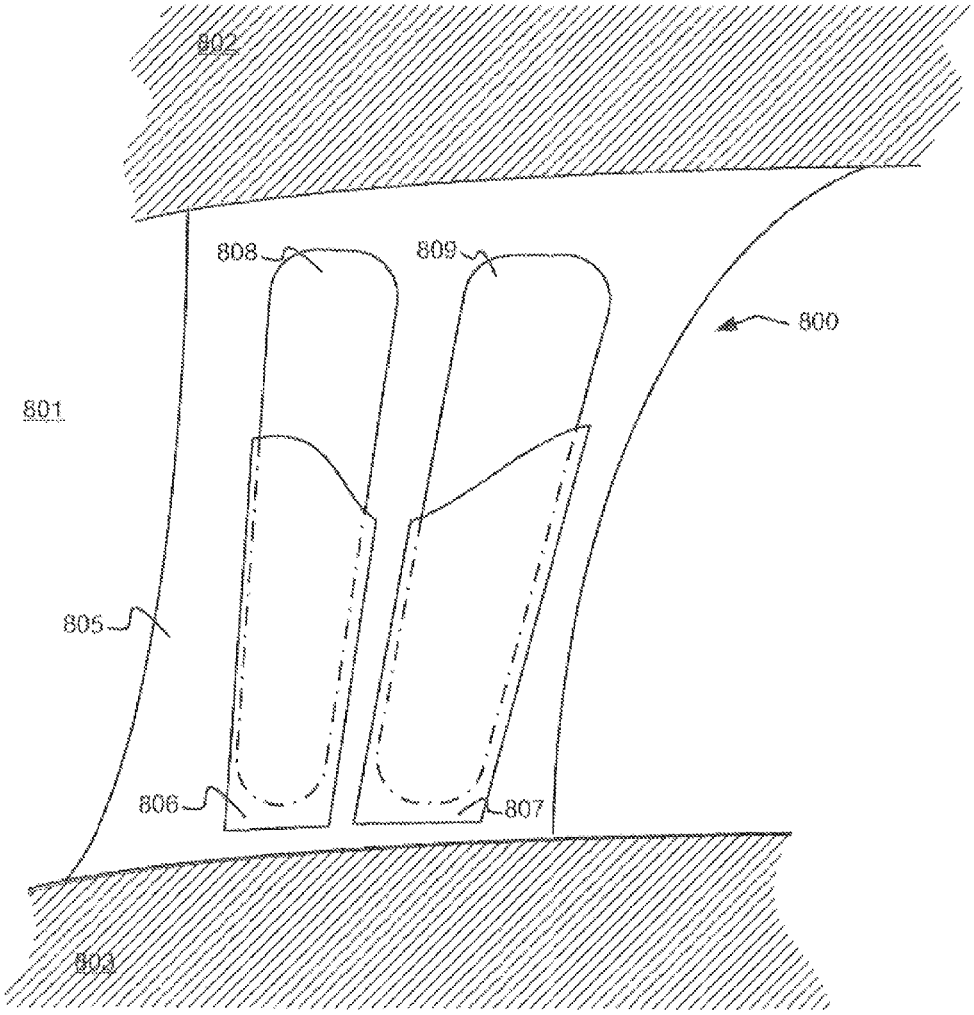
FIG. 8 is a cut-away side view of a structural guide vane within a gas turbine engine in accordance with an embodiment of the invention.

While the use of the described principles is not limited to structural guide vanes, this represents one possible usage context of the described principles. To this end, FIG. 8 is a cut-away side view of a structural guide vane 800 applying the described principles. In particular, the illustrated guide vane 800 bridges an internal passage 801 within a gas turbine engine. A first end of the guide vane 800 is affixed to a support structure 802, which may be an engine housing, fairing, strut or other component. The distal end 803 of the guide vane 800 is affixed to an internal engine structure 804, such as a shaft bearing mount for an engine shaft (not shown) or other support structure or engine component.

The visible surface 805 of the vane 800 is shown with covering members 806 and 807 partially cut away for clarity. Each of the covering members 806 and 807 covers an associated cavity 808, 809. One or both of the cavities 808, 809 may be filled with a filler material in the manner discussed above. Alternatively, at least one of the cavities 808, 809 is left unfilled for tuning the frequency response of the vane 800.

In accordance with the described principles, a set of guide vanes, i.e., a group of vanes that includes vanes from a plurality of classes, e.g., with a plurality of degrees of camber, can be viewed as a set of guide vanes having a common front portion and a variable rear portion providing the necessary camber. Such a set of vane classes is tuned by tuning the front portion and the rear portion separately. Thus, in each class, a front portion is substantially the same as in each other class, with respect to depth and extent of cavitation, degree of filling, degree of covering and/or other frequency-affecting variables. In contrast, the rear portion of vanes in each class is individually tuned, such that the rear portions are not substantially the same across classes.

In this way, while the differing degree of camber reflected in the rear portion of vanes of different classes would lead to different frequency response once the front portion is tuned across classes in the absence of tuning to the rear portion, the frequency response of each class can then be individually tuned by differing degrees of covering, filling, etc. in the rear portion of the vane. A group of guide vanes produced in this way for use in a gas turbine engine, for example, will include guide vanes representing different vane classes, each class having a different degree of camber than that of other classes. Each vane, regardless of class, will have a similarly tuned front portion, as described above, but the vanes of each class may differ from the vanes of at least one other class with respect to the tuning of the rear portion of the vanes. In this way, the frequency response variation introduced by camber differences can be accommodated such that no vane of any class in the set exhibits a response mode falling within an engine vibration (excitation) band.

Figure 9:
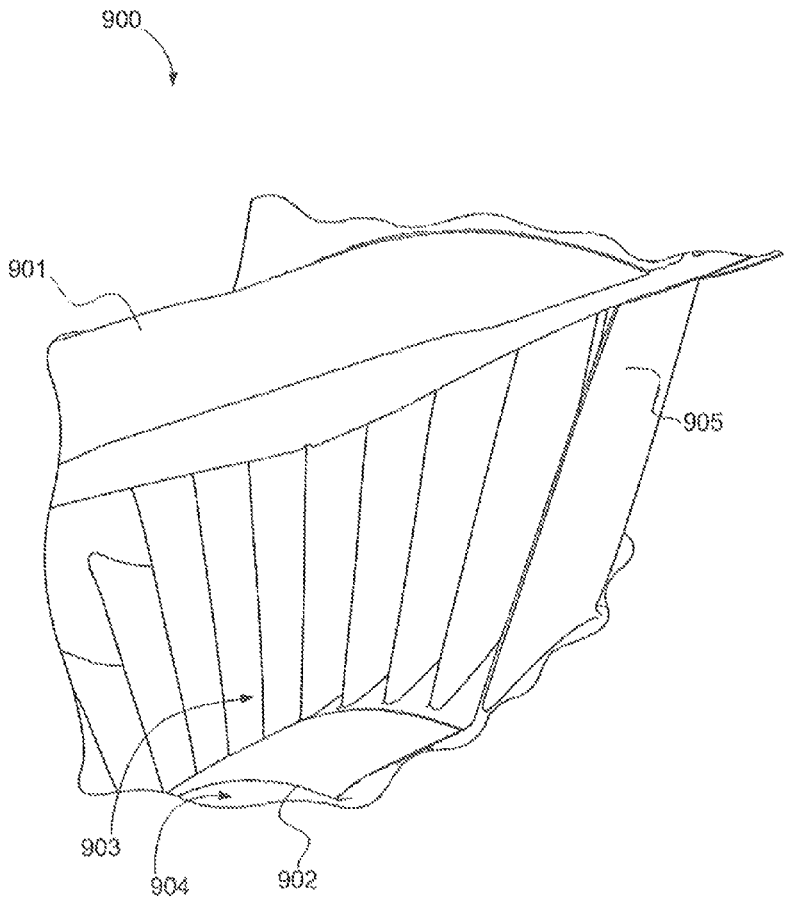
FIG. 9 is a cut-away perspective view of a portion of a gas turbine engine within which embodiments of the invention may be implemented.

FIG. 9 is a cut-away perspective view of a portion of a gas turbine engine within which embodiments of the invention may be implemented. In the illustrated embodiment, the engine 900 includes a fan case 901 which forms an external surface of the engine 900. Within the fan case 901, a splitter 902 serves to divide engine airflow between an annular outer bypass channel 903 and an annular inner primary engine passage 904. The annular outer bypass channel 903 is bridged by one or more static vanes 905. The one or more static vanes 905 may be constructed as described above, with one or more cavities therein, as well as an optional nonmetallic filling material in one or more of the cavities and/or optional cover elements over one or more of the cavities in order to adjust the modal response of the vane.

Each vane has an airfoil cross-section having an associated camber. Where a plurality of vanes 905 are provided, multiple different airfoil profiles and associated cambers may be employed. In particular, the resistance of an obstruction, not shown, downstream from the vanes 905 may be mitigated by directing the airflow around the obstruction. This can be accomplished by employing vanes 905 of different airfoil/camber characteristics depending upon where they are located relative to the obstruction.

Figure 10:
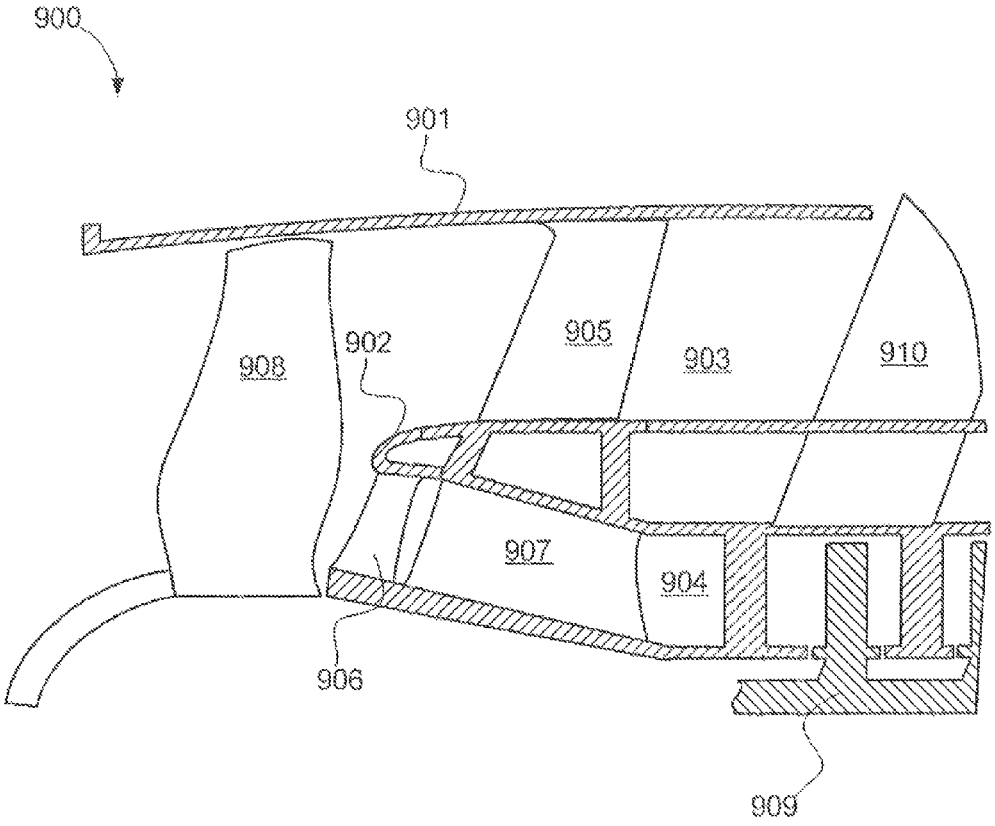
FIG. 10 is a cross-sectional view of a gas turbine engine within which embodiments of the invention may be implemented.

FIG. 10 is a cross-sectional view of the gas turbine engine 900, showing the noted elements in conjunction with other elements. As noted in reference to FIG. 9, the engine 900 includes a fan case 901 forming an external surface of the engine 900, and a splitter 902 dividing engine airflow between the annular outer bypass channel 903 and the annular inner primary engine passage 904. One of the one or more static vanes 905 is illustrated bridging the annular outer bypass channel 903.

Also visible in the illustration of FIG. 10 is an inlet guide vane 906, which guides air into the annular inner primary engine passage 904. The front center body 907 of the engine 900 is located behind the inlet guide vane 906. A set of fan blades 908 provides intake air to both the annular inner primary engine passage 904 and the annular outer bypass channel 903. Within the annular inner primary engine passage 904, one or more compressor stages 909 compress the intake air as it passes rearward toward one or more combustion chambers, not shown. An obstruction 910, such as an engine mounting component, is located downstream from the vanes 905.

As noted, the one or more static vanes 905 may be constructed of a lightened construction such as that shown in FIGS. 2-4C and FIGS. 6-8. In addition or alternatively, other components of the engine 900 may be constructed in the same manner. In each such case, the component of interest may be tuned to avoid destructive vibration in the manner disclosed above.

It will be appreciated that the foregoing description provides useful examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context, and other alternative orders and steps may be practicable where logically appropriate without departing from the described principles.

I claim:

1. A set of vanes for use in a gas turbine, the set comprising:

at least a first vane having a first camber, the first vane having an airfoil-shaped body portion having a plurality of cavities on at least one surface thereof, the first vane having a first degree of coverage by a first cover portion, wherein a degree of coverage represents an extent to which cavities of a surface are covered, the first vane having a first frequency response with at least a first mode; and at least a second vane having a second camber different from the first camber, the second vane having an airfoil-shaped body portion having a plurality of cavities on at least one surface thereof, the second vane having a second degree of coverage by a second cover portion, the second vane having a second frequency response with at least a second mode;

wherein the first camber differs from the second camber and the second degree of coverage differs from the first degree of coverage.

2. The set of vanes for use in a gas turbine in accordance with claim 1, wherein neither of the first and second modes falls within a predetermined frequency band.

3. The set of vanes for use in a gas turbine in accordance with claim 1, wherein the plurality of cavities are located at least on respective suction surfaces of the first and second vanes.

4. The set of vanes for use in a gas turbine in accordance with claim 1, wherein the plurality of cavities are located at least on respective pressure surfaces of the first and second vanes.

5. The set of vanes in accordance with claim 1, wherein each of the first and second degrees of coverage fall within a range from greater than and not equal to zero coverage to less than and not equal to full coverage.

6. The set of vanes in accordance with claim 1, wherein at least one of the first and second cover portions comprises a plurality of covering members.

7. The set of vanes in accordance with claim 1, wherein a subset of the cavities of at least one of the first vane and the second vane is filled with a nonmetallic filler material.

8. The set of vanes in accordance with claim 7, wherein the nonmetallic filler material is a structural foam material.

9. The set of vanes in accordance with claim 7, wherein the nonmetallic filler material comprises an added constituent including at least one of a fiber material and a microsphere material.

10. The set of vanes in accordance with claim 7, wherein at least one of the subset of the cavities is both filled and covered.

11. A method for tuning modes of a set of differently cambered vanes for use in a gas turbine, the method comprising:

providing a first plurality of vanes having a first camber and having a plurality of cavities on at least one surface thereof;

providing a second plurality of vanes having a second camber and having a plurality of cavities on at least one surface thereof, wherein the second camber differs from the first camber;

tuning a frequency response of the first plurality of vanes by at least one of covering and filling of each cavity in each vane of the first plurality of vanes with a filler material such that the first plurality of vanes have a first set of frequency modes, and none of the first set of frequency modes falls within a predetermined band; and tuning a frequency response of the second plurality of vanes by identifying a front portion of the second airfoil that is substantially the same as a front portion of the first airfoil, covering or filling each cavity in the front portion of each vane of the second plurality of vanes in the same manner as each cavity in the front portion of each vane of the first plurality of vanes, and independently tuning a remaining portion of each vane of the second plurality of vanes by at least one of covering and filling of each cavity in the remaining portion.

12. The method for tuning modes of a set of differently cambered vanes in accordance with claim 11, wherein the plurality of cavities are located on at least respective suction surfaces of the first and second pluralities of vanes.

13. The method for tuning modes of a set of differently cambered vanes in accordance with claim 11, wherein the plurality of cavities are located on at least respective pressure surfaces of the first and second pluralities of vanes.

14. The method for tuning modes of a set of differently cambered vanes in accordance with claim 11, further comprising tuning the frequency response of at least one of the first and second plurality of vanes by adjusting one or more of a depth of the cavities, a ratio of cavitated surface area to non-cavitated surface area, addition of ribs, removal of ribs, and a change in a density, strength, or resilience of the filler material.

15. The method for tuning modes of a set of differently cambered vanes in accordance with claim 11, wherein the filler material comprises a nonmetallic filler material.

16. The method for tuning modes of a set of differently cambered vanes in accordance with claim 15, wherein the nonmetallic filler material is a structural foam material.

17. The method for tuning modes of a set of differently cambered vanes in accordance with claim 15, wherein the nonmetallic filler material comprises an added constituent including at least one of a fiber material and a microsphere material.

18. The method for tuning modes of a set of differently cambered vanes in accordance with claim 11, wherein a cavity of at least one of the first plurality of vanes and the second plurality of vanes is both filled and covered.

19. A gas turbine engine comprising:

an annular passage configured to direct a flow of gaseous material; and a vane disposed at least partially within the annular passage, the vane comprising:

a cambered airfoil body having a leading edge, trailing edge, pressure surface, and suction surface;

a plurality of cavities formed in at least one of the pressure surface and the suction surface, with at least a subset of the plurality of cavities being filled with a nonmetallic filler material and a remainder of the plurality of cavities being unfilled with the nonmetallic filler material; and a cover affixed to the cambered airfoil body so as to cover the remainder of the plurality of cavities, wherein the cover also covers a portion of the subset of the plurality of cavities filled with the nonmetallic filler material.

20. The gas turbine engine in accordance with claim 19, wherein the nonmetallic filler material is a structural foam material.

21. The gas turbine engine in accordance with claim 19, wherein the cover comprises a plurality of separate covering parts.

22. The gas turbine engine in accordance with claim 19, wherein the plurality of cavities are formed in one but not both of the pressure surface and the suction surface.

* * * * *